US005365990A

United States Patent [19]

Ueda

[11] Patent Number: 5,365,990

[45] Date of Patent: Nov. 22, 1994

[54] HEAT INSULATING SHUTTER DEVICE

[75] Inventor: Kenji Ueda, Tokyo, Japan

[73] Assignee: Showa Orifa Co., Ltd., Tokyo, Japan

[21] Appl. No.: 835,302

[22] Filed: Feb. 14, 1992

[30] Foreign Application Priority Data

Feb. 18, 1991 [JP] Japan ..... 3-006664[U]

[51] Int. Cl.[5] ..... E06B 9/08

[52] U.S. Cl. ..... 160/23.1; 160/133; 160/236

[58] Field of Search ..... 160/33, 36, 23.1, 133, 160/132, 236, 235, 271, 98, 107, 267.1, 268.1, 270

[56] References Cited

U.S. PATENT DOCUMENTS

| | | | |
|---|---|---|---|
| 4,343,340 | 10/1982 | Paule | 160/235 X |
| 4,365,660 | 12/1982 | Henkenjohann | 160/133 |
| 4,445,958 | 5/1984 | Jaksha | 160/133 X |
| 4,467,853 | 8/1984 | Downey, Jr. | 160/41 X |
| 4,630,664 | 12/1986 | Magro | 160/236 X |
| 4,723,588 | 2/1988 | Ruppel | 160/235 X |
| 4,776,379 | 10/1988 | Kraeutler | 160/271 X |
| 4,972,894 | 11/1990 | Machill | 160/235 |
| 5,165,746 | 11/1992 | Teiger | 160/236 X |

FOREIGN PATENT DOCUMENTS

| | | | |
|---|---|---|---|
| 2468718 | 8/1981 | France . | |
| 0212476 | 4/1897 | Germany . | |
| 7000159 | 12/1969 | Germany . | |
| 7216465 | 8/1972 | Germany . | |
| 2237737 | 2/1974 | Germany . | |
| 7803892 | 9/1978 | Germany . | |
| 3041347 | 6/1982 | Germany | 160/33 |
| 8622304 | 11/1986 | Germany . | |

*Primary Examiner*—Blair M. Johnson

*Attorney, Agent, or Firm*—Armstrong, Westerman, Hattori, McLeland & Naughton

[57] ABSTRACT

A heat insulating shutter device includes a coiled shutter housing provided on an upper edge portion of a building vertical wall which defines an opening formed in the wall and having a sliding window. The housing has an outlet in its lower end and a drive horizontal roller in its interior for winding and unwinding a shutter. The shutter comprises a multiplicity of slats interconnected so as to be wound up to a coiled form and is connected to the roller by striplike attaching members. Opposite side edge portions of the wall defining the opening each have a hollow side frame, and a lower edge portion of the wall forming the opening is provided with a hollow lower frame. Grooved shutter guides, which are opposed to each other and each attached to an inner wall of the side frame, have movably fitted therein respective opposite side edge portions of the shutter. The slats of the shutter, the side frames and the lower frame each have a hollow portion filled with urethane foam serving as a heat insulating material.

19 Claims, 4 Drawing Sheets

HEAT INSULATING SHUTTER DEVICE

BACKGROUND OF THE INVENTION

The present invention relates to heat insulating shutter devices.

As disclosed, for example, in Unexamined Japanese Utility Model Publication No. 117992/1988, heat insulating shutter devices are already known which comprise a coiled shutter housing provided on an upper edge portion of a vertical wall of a building defining an opening in the wall, with a shutter outlet formed in the lower end of the housing, a shutter winding-unwinding horizontal drive roller disposed within the housing, a shutter attached to the drive roller and comprising a multiplicity of slats connected to one another so as to be wound up to a coiled form, and a guide rail provided on each of opposite side edge portions of the wall defining the opening. Such a shutter device is low in heat insulating properties since it is usually made of metal which is a good conductor of heat. However, it is required that the interior of the building be kept warm during winter and cool during summer.

SUMMARY OF THE INVENTION

The main object of the present invention is to provide a heat insulating shutter which fulfills this requirement.

The shutter device of the present invention comprises a coiled shutter housing provided on an upper edge portion of a vertical wall of a building defining an opening in the wall, the housing having a lower end formed with a shutter outlet, a shutter winding-unwinding horizontal drive roller disposed within the housing, a shutter attached to the drive roller and comprising a multiplicity of slats connected to one another so as to be wound up to a coiled form, a hollow side frame provided on each of opposite side edge portions of the wall defining the opening, and grooved shutter guides opposed to each other and each provided on an inner wall of the side frame, the shutter guides having movably fitted therein respective opposite side edge portions of the shutter, the slats of the shutter and the side frames each having a hollow portion filled with a heat insulating material. When the shutter is closed, the heat insulating material in the hollow portions of the shutter slats and the heat insulating material in the side frames prevent transfer of heat between the outside and the inside of the building, consequently precluding outside cold or hot air from ingressing into the building.

The present invention will be described in greater detail with reference to the accompanying drawings.

DESCRIPTION OF THE PREFERRED EMBODIMENTS

Figure 1:
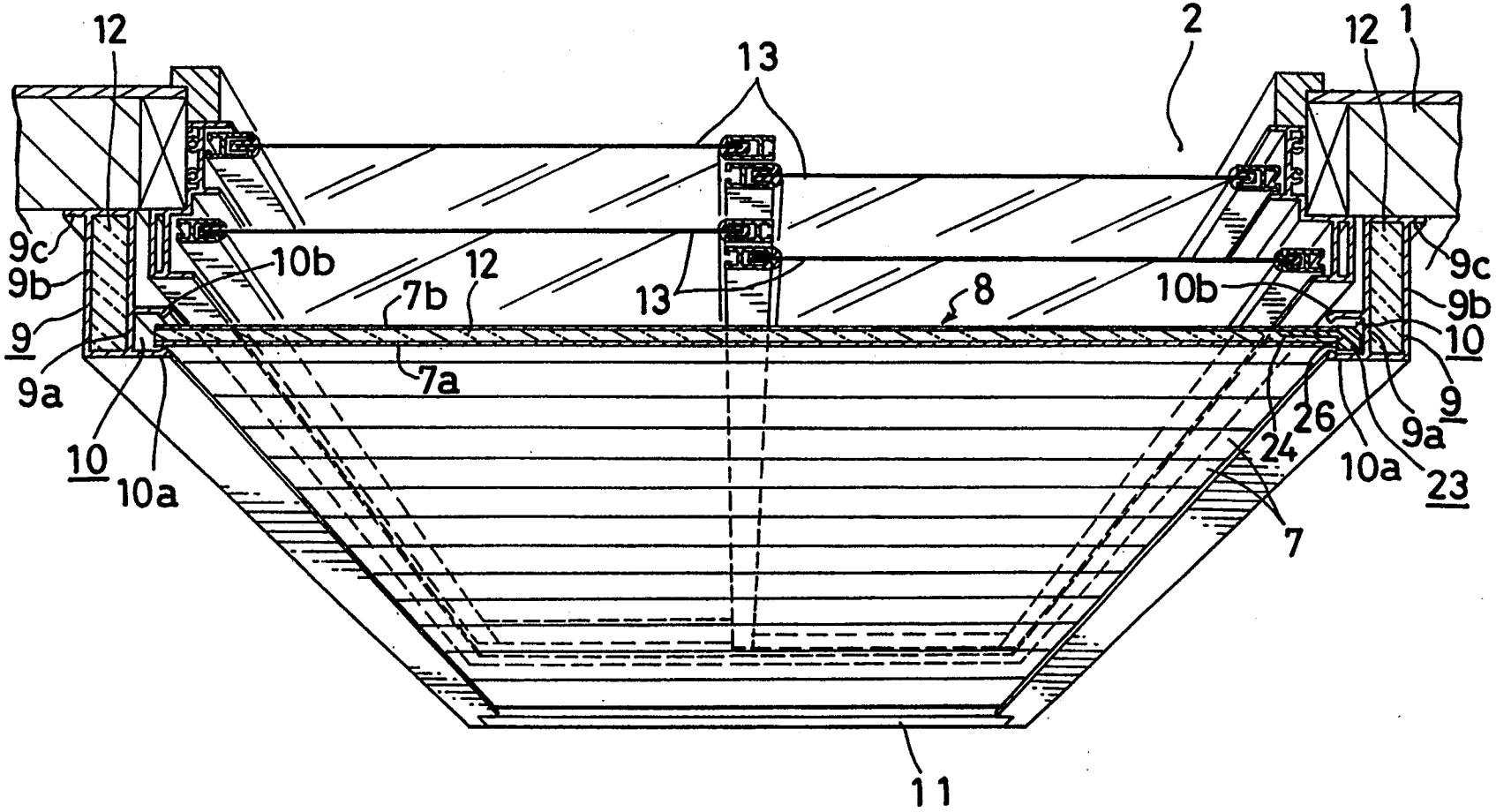
FIG. 1 is a perspective view including a horizontal section and showing a shutter device embodying the invention.
Figure 2:
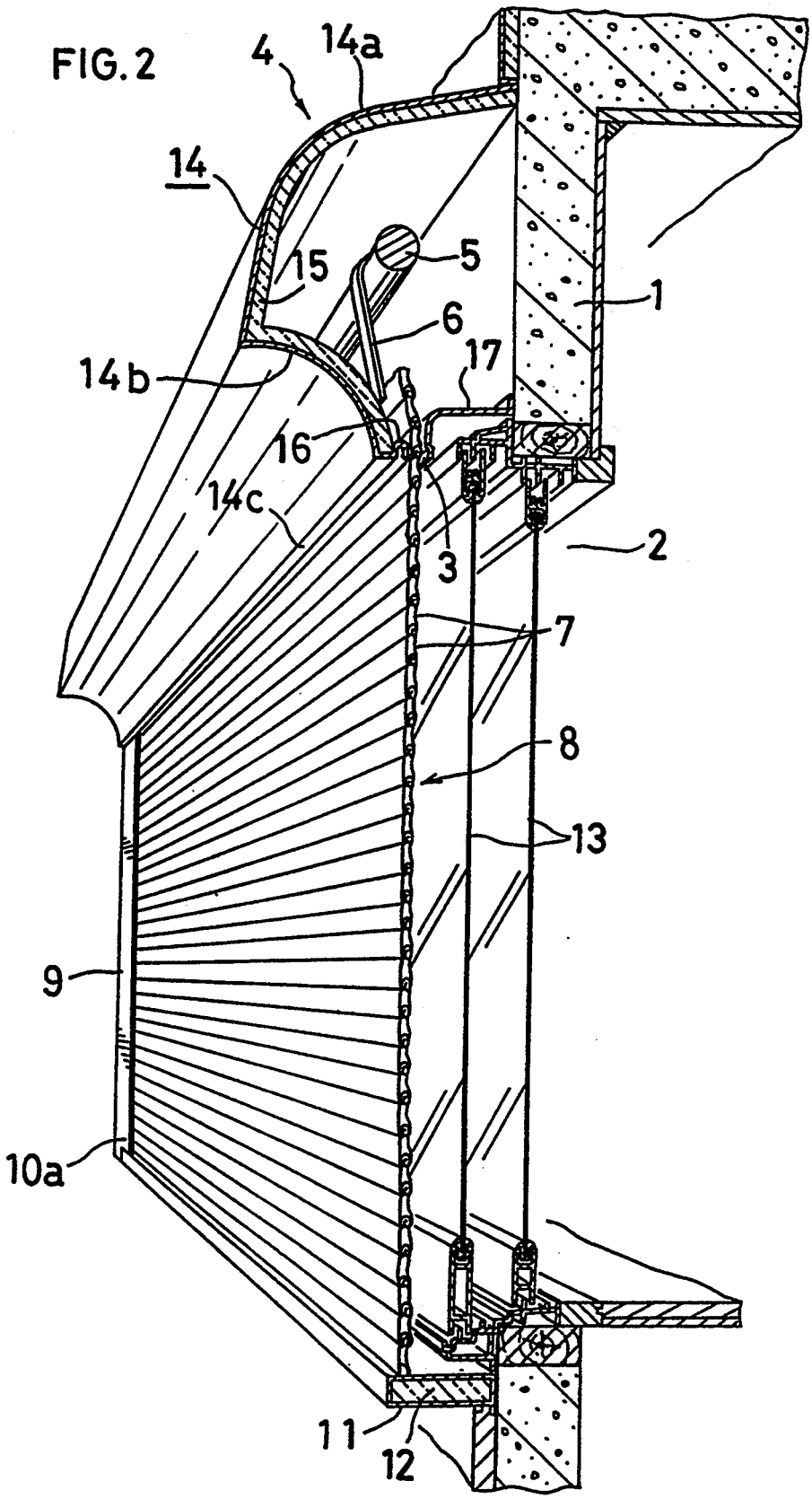
FIG. 2 is a perspective view including a vertical section and showing the shutter device of FIG. 1.
Figure 5:
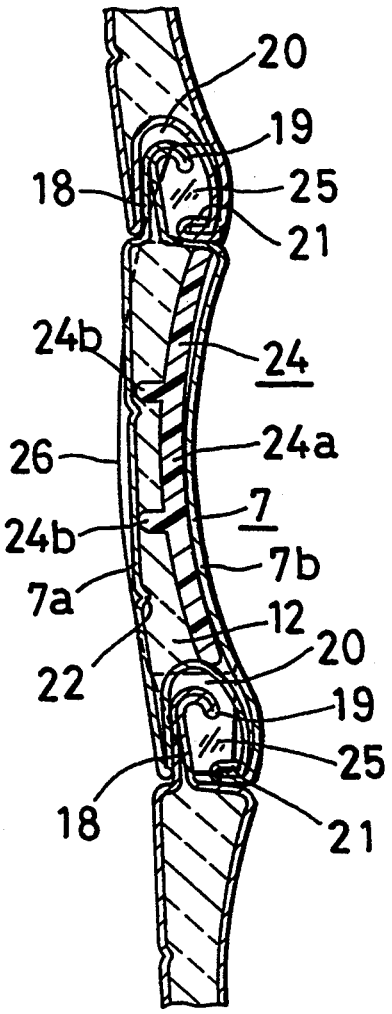
FIG. 5 is an enlarged view in section taken along the line 5—5 in FIG. 4.
Figure 3:
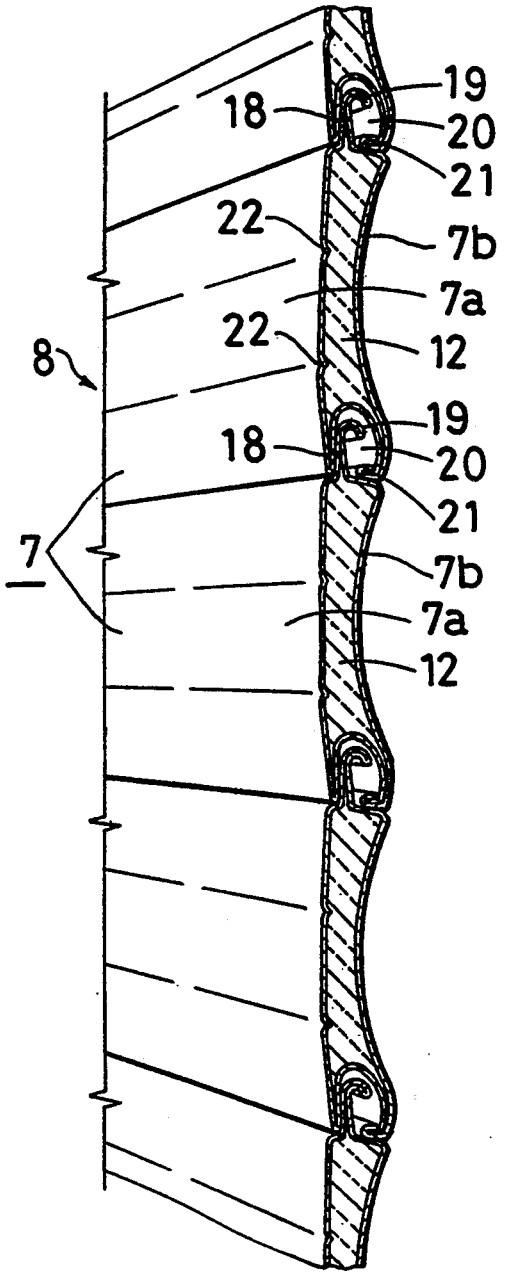
FIG. 3 is an enlarged fragmentary perspective view including a vertical section and showing a shutter.
Figure 4:
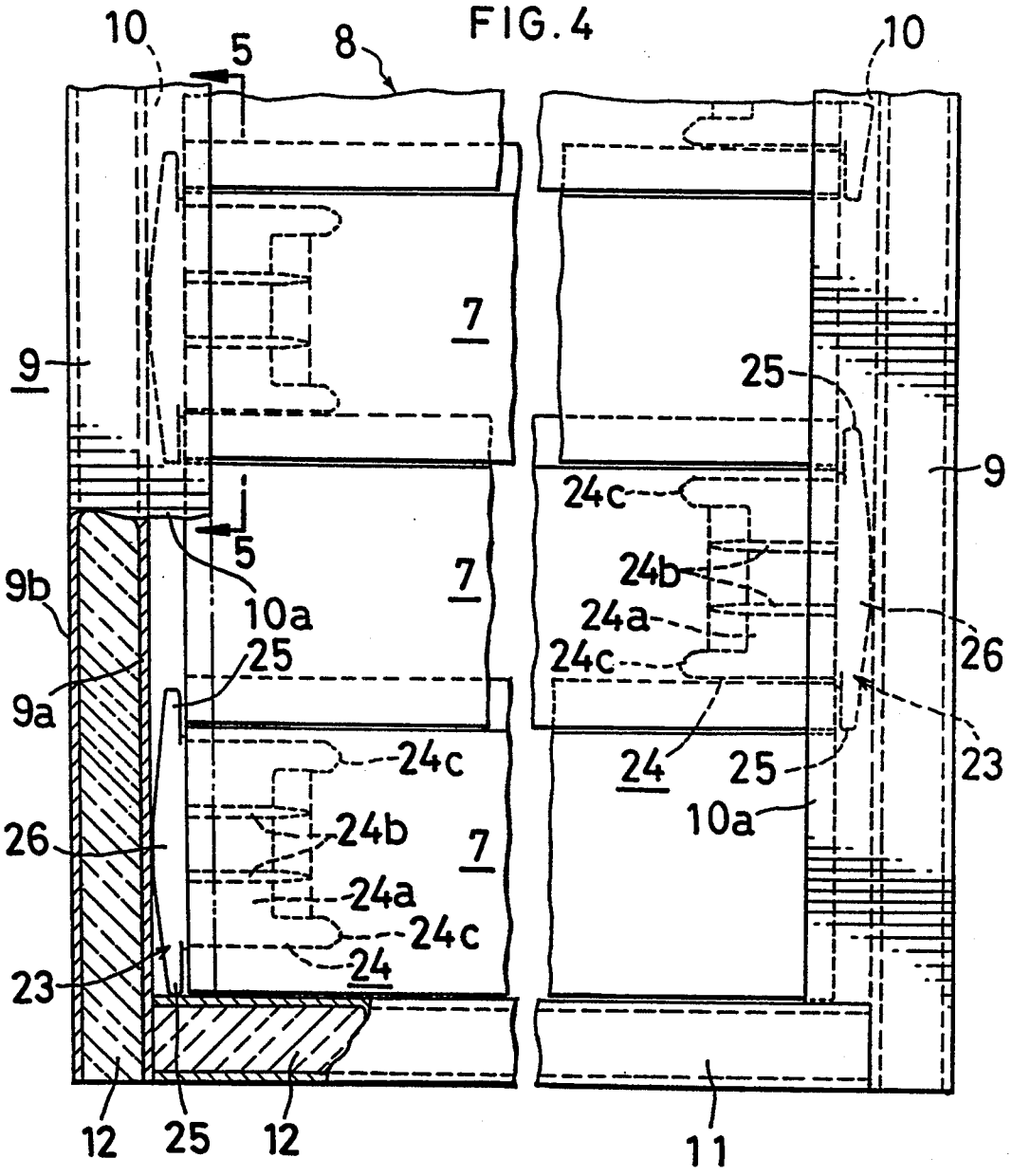
FIG. 4 is an enlarged front view partly broken away or omitted and showing the lower portions of opposite side frames and of the shutter, and a lower frame.

With reference to FIGS. 1 to 5, the illustrated heat insulating shutter device comprises a housing 4 adapted to accommodate a shutter 8 in a coiled form and provided on an upper edge portion of a vertical wall 1 of a building defining part of an opening 2 in the wall 1, with a shutter outlet 3 formed in the lower end of the housing 4; a horizontal drive roller 5 disposed within the housing 4 for winding and unwinding the shutter 8; the shutter 8 which is attached to the drive roller 5 with a plurality of striplike attaching members 6 and which comprises a multiplicity of slats 7 connected to one another so as to be wound up to the coiled form; a hollow side frame 9 rectangular in cross section and provided on each of opposite side edge portions of the wall 1 defining the opening 2; grooved shutter guides 10 opposed to each other and each provided on the front edge portion of inner wall 9*a* of the side frame 9, the shutter guides 10 having movably fitted therein respective opposite side edge portions of the shutter 8; and a hollow lower frame 11 having a rectangular cross section and provided on a lower edge portion of the wall 1 defining the opening 2. Each slat 7 of the shutter 8 has a hollow portion filled with a heat insulating material 12. The hollow portions of the side frames 9 and of the lower frame 11 are also filled with the material 12. The opening 2 is provided with a sliding window 13. When both the shutter 8 and the window 13 are closed, an air layer is formed therebetween.

The shutter housing 4 comprises a cover 14 having a layer 15 of heat insulating material over the entire inner surface thereof and composed of an eave 14*a* and a front lower closure 14*b*. The eave 14*a* has a forwardly downward arcuate cross section and is fixed at its upper edge to the vertical wall 1 of the building. The closure 14*b* is integral with the eave 14*a* and has an arcuate cross section curved inward and rearwardly downward. The housing further comprises a rearward horizontal projection 14*c* integral with the lower edge of the cover 14 and supporting the lower end of the heat insulating material layer 15, an outlet forming front member 16 having an inverted U-shaped cross section and integral with the rear side of the projection 14*c*, and an outlet forming rear member 17 having an inverted L-shaped cross section, provided on the vertical wall 1 of the building and positioned at a predetermined distance downward from the upper edge of the eave 14*a*.

The grooved shutter guides 10 each have a pair of opposed walls 10*a*, 10*b* extending longitudinally thereof and cut away at their lower ends by an amount corresponding to the height of the lower frame 11. The lower frame 11 is held at its opposite ends in intimate contact with the inner walls 9*a* of the respective side frames 9 and is thereby positioned between the side frames 9 flush with the front surfaces of the side frames 9. The outer wall 9*b* of each side frame 9 is provided at its rear edge with an attaching portion 9*c* along the building vertical wall 1.

The slats 7, side frames 9, lower frame 11, cover 14 including the rearward horizontal projection 14*c* and the outlet forming front member 16, and outlet forming rear member 17 are made of aluminum. A fluorocarbon resin film is formed over the entire outer surface of the cover 14. Urethane foam is used as the heat insulating material 12 and also as the material for the layer 15.

Each of the slats 7 is provided at its upper edge with an upward projection 18 extending longitudinally thereof and having a rearwardly downward hook 19 at the top. The slat 7 is formed in its lower edge with a recess 20 facing downward and having an inverted U-shaped cross section for almost entirely accommodating the hooked upward projection 18 of the lower slat adjacent thereto upwardly or downwardly movably. A forward horizontal projection 21 is formed on a recess-defining rear edge of the slat and extends longitudinally thereof so that when the lower slat moves down under gravity, the hook 19 thereof bears on the horizontal projection 21. The upward projection 18 has unillustrated lighting-ventilating horizontal slits arranged longitudinally thereof at a predetermined spacing. The slat 7 has a front wall 7*a* formed with a plurality of parallel rearwardly protruding ribs 22 extending longitudinally thereof.

A synthetic resin slide member 23 slidable on the bottom of the groove of the shutter guide 10 is attached to each of the multiplicity of slats 7 providing the shutter 8. The slide members 23 are arranged from above downward alternately at the right end and the left end of the slat 7. The slide member 23 comprises an insert 24 inserted in a hollow end portion of the slat 7 between the upward projection 18 and the slat 7 and the recess 20 thereof, and a head 26 covering the end face of the slat 7 and having upper and lower blades 25 for preventing lateral displacement of the slat. The head 26 has a flat midportion in contact with the bottom of the shutter guide 10, and upper and lower portions which are so inclined as to be a gradually increasing distance away from the bottom as they extend from the midportion toward the ends of the respective upper and lower blades 25. The insert 24 of the slide member 23 comprises a portion 24*a* having an arcuate cross section substantially along the rear wall 7*a* of the slat 7, and two horizontal forward ridges 24*b* provided in parallel on the front surface of the arcuate portion 24*a* and spaced apart by a distance. The bladed head 26 of the slide member 23 is arcuated with approximately the same curvature as the arcuate portion 24*a* of the insert 24 when seen sidewise.

The insert 24 of the slide member 23 is provided at the upper and lower portions of its inner end with horizontal projections 24*c* which are sharp-pointed. When the insert 24 is to be inserted into the hollow end portion of the slat 7, the corresponding portion of the heat insulating material 12 is removed.

When the horizontal roller 5 is rotated by unillustrated drive means in a direction to unwind the shutter 8, lowering the shutter 8 as guided by the guides 10, the slat 7 in the lowermost position comes into contact with the lower frame 11. Until this slat contacts the frame, the hook 19 of each slat 7 bears on the forward horizontal projection 21 of the upper slat 7 adjacent thereto under gravity, whereby the hooked upward projection 18 having the lighting-ventilating slits is left exposed. When the interior of the building needs to be lighted or ventilated with the shutter 8 lowered, the shutter 8 is held in this state. If the shutter 8 is further unwound from the roller 5 after the lowermost slat 7 has come into contact with the lower frame 11 as described above, the upward projection 18 of the lower slat 7 is brought into the recess 20 of the upper slat 7, with the result that the upper edge of the former slat 7 is brought into intimate contact with the lower edge of the latter slat 7. Thus, the shutter 8 is completely closed.

Figure 6:
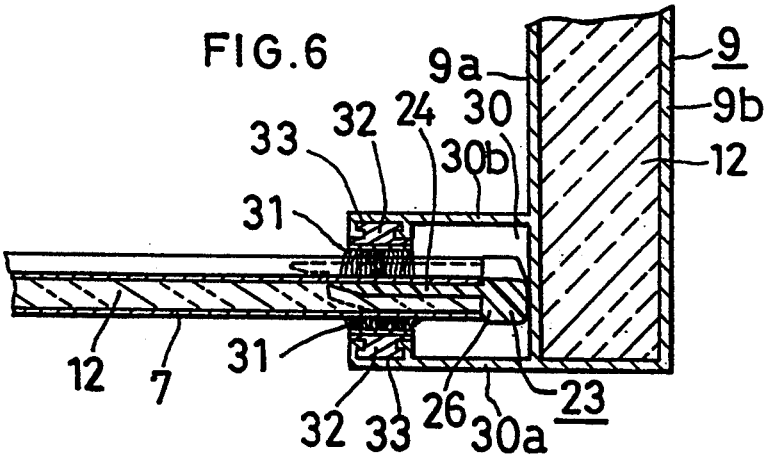
FIG. 6 is an enlarged view in horizontal section showing a modified grooved shutter guide.

FIG. 6 shows a modified grooved shutter guide 30.

The shutter guide 30 has a pair of opposed walls 30*a*, 30*b*, and a multiplicity of chemical fiber tufts 31 for preventing ingress of dust are provided on the opposed walls 30*a*, 30*b* in the form of a strip extending longitudinally of each of the walls on an edge portion thereof. The strips of tufts are opposed to each other with the side edge portion of the shutter 8 interposed therebetween when the shutter is in its closed position. Such tufts 31 are implanted in a base fabric, which is affixed to one surface of a striplike member 32 having an H-shaped cross section. The edge portions of the pair of opposed walls 30*a*, 30*b* have internally enlarged grooves 33 which are opposed to each other, and the striplike member 32 is fitted in each groove 33, with the tuft bearing wall thereof exposed.

The opening may be provided with another kind of window or door in place of the sliding window. The lower frame need not be provided if the lower end of the opening is defined by a floor.

What is claimed:

1. A heat insulating shutter device, comprising:

a coiled shutter housing adapted to be provided on an upper edge portion of an outside surface of a vertical wall of a building defining an opening in the wall, the housing having a lower end formed with a shutter outlet, a shutter winding-unwinding horizontal drive roller disposed within the housing, and a shutter attached to the drive roller;

said shutter including a multiplicity of slats connected to one another so as to be wound up to a coiled form;

a hollow side frame provided on each of opposite side edge portions of the wall defining the opening;

grooved shutter guides opposed to each other and each provided on inner walls of the side frames;

the shutter guides having movably fitted therein respective opposite side edge portions of the shutter;

the slats of the shutter and the side frames each having a hollow portion filled with a heat insulating material; and wherein the shutter housing includes (a) a cover having an upper sidewall portion, a front sidewall portion and a lower sidewall portion, (b) said shutter outlet being in said lower sidewall portion, (c) the upper sidewall portion being forwardly downwardly inclined over a substantial portion thereof and being fixable at its upper edge to the outside vertical wall of the building, and (e) the lower sidewall portion providing a concave surface, thereby being rearwardly inclined downward over a substantial portion thereof in front of the shutter outlet.

2. The heat insulating shutter device according to claim 1, further comprising:

said hollow side frames each including a rectangular column having a substantially rectangular cross-section, said hollow portion of said frames being within each said rectangular column, and said rectangular cross-section of each said rectangular column extending outwardly from the wall in a lengthwise direction;

a wall surface extending laterally from a first side of each said rectangular column against the wall so as to form an attaching portion for attaching the frame to the wall;

said grooved shutter guides extending from each said rectangular column on an inner wall surface of the respective rectangular column and said grooved shutter guides having two opposed walls extending inward off from said inner wall surface along the respective rectangular column so as to form a channel for receiving the shutter, the heat insulating material within said rectangular columns extending behind the respective said channel, and said channel being substantially narrower than said length of said rectangular cross-section of said rectangular column; and a hollow lower frame having a rectangular cross section provided between the lower ends of the side frames on a lower edge portion of the vertical wall defining the opening, the lower frame having a hollow portion filled with a heat insulating material.

3. A heat insulating shutter device as defined in claim 2, wherein the side frame is made of aluminum and said hollow lower frame is made of aluminum.

4. A heat insulating shutter device as defined in claim 2 wherein each of the shutter guides has a pair of opposed walls, and a multiplicity of chemical fiber tufts for preventing ingress of dust are provided on the opposed walls in the form of a strip extending longitudinally of each of the opposed walls on an edge portion thereof, the strips of tufts being opposed to each other with the side edge portion of the shutter interposed therebetween when the shutter is in a closed position.

5. A heat insulating shutter device as defined in claim 2 wherein each of the slats is provided at its upper edge with an upward projection extending longitudinally thereof and having a rearwardly downward hook at the top, each of the slats being formed in its lower edge with a recess facing downward and having an inverted U-shaped cross section for almost entirely accommodating the hooked upward projection of the lower slat adjacent thereto upwardly or downwardly movably, a forward horizontal projection being formed on a recess-defining rear edge of each slat and extending longitudinally thereof so that when the lower slat moves down under gravity, the hook thereof bears on the horizontal projection.

6. A heat insulating shutter device as defined in claim 5 wherein a synthetic resin slide member slidable on the bottom of the groove of the shutter guide is attached to each of the multiplicity of slats providing the shutter, and the slide members are arranged from above downward alternately at the right end and the left end of the slat.

7. A heat insulating shutter device as defined in claim 6 wherein the slide member comprises an insert inserted in a hollow end portion of the slat between the upward projection of the slat and the downwardly facing recess thereof, and a head covering the end face of the slat and having upper and lower blades for preventing lateral displacement of the slat.

8. A heat insulating shutter device as defined in claim 1 wherein a fluorocarbon resin film is formed over the entire outer surface of the cover.

9. A heat insulating shutter device as defined in claim 1 wherein the outlet forming front member has an inverted U-shaped cross section, and the outlet forming rear member has an inverted L-shaped cross section.

10. The heat insulating shutter device according to claim 1, further comprising:

the opening being provided with a sliding window, an air layer being formed between the shutter and the window when both the shutter and the window are in a closed state.

11. A heat insulating shutter device as defined in claim 7, wherein said channel formed by said two opposed walls includes two opposed strip like members each on one of the inside surfaces of the opposed walls facing one another and having a fiber tuft extending on the surface thereof, said strip like members being fitted within respective flange portions formed on each of the opposed walls.

12. The heat insulating shutter device according to claim 1, further comprising:

wherein each of the slats is provided at its upper edge with an upward projection extending longitudinally thereof and having a rearwardly downward hook at the top, each of the slats being formed in its lower edge with a recess facing downward and having an inverted U-shaped cross section for almost entirely accommodating the hooked upward projection of the lower slat adjacent thereto upwardly or downwardly movably, a forward horizontal projection being formed on a recess-defining rear edge of each slat and extending longitudinally thereof so that when the lower slat moves down under gravity, the hook thereof bears on the horizontal projection; and said slats including a generally flat front wall surface and a generally arcuate rear wall surface, said front wall surface having a plurality of rearwardly protruding ribs extending along the length thereof, and said slats having a single aluminum sheet forming the perimeter thereof so as to be constructed from a single piece.

13. The heat insulating shutter device according to claim 1, further comprising:

wherein a synthetic resin slide member slidable on the bottom of the groove of the shutter guide is attached to each of the multiplicity of the slats providing the shutter, and the slide members are arranged from above downward alternately at the right end and the left end of the slat;

wherein the slide member includes an insert inserted in a hollow end portion of the slat between an upward projection of the slat and a downward facing recess of the slat and a head covering the end face of the slat and having upper and lower blades for preventing lateral displacement of the slat; and wherein said insert has a curvature which corresponds to a curvature of a rear wall of the slat, and said insert has a width substantially narrower than the width of the slat, and said insert has two or more horizontal ribs extending along the insert and to an opposite front inner wall surface of the slat.

14. The heat insulating shutter device of claim 2, wherein said hollow portions of said hollow side frames and said hollow lower frame are each substantially rectangular and encompass substantially the entire cross section of each of the frames.

15. The heat insulating shutter device according to claim 1, wherein said housing is made out of aluminum and a layer of heat insulating material covers a portion of said upper sidewall portion, said front sidewall portion and said lower sidewall portion.

16. The heat insulating shutter device according to claim 15, wherein said housing is made out of aluminum and a layer of heat insulating material covers a portion of said upper sidewall portion, said front sidewall portion and said lower sidewall portion.

17. The heat insulating shutter device according to claim 15, wherein said housing is made of aluminum.

18. The heat insulating shutter device according to claim 17, wherein a fluro-carbon resin coating is applied over the outer surface of said housing.

19. A structure comprising, in combination:

(1) a building having an interior and an exterior defined at least in part by a vertical external wall, said vertical external wall having an opening therein extending from an outside surface of said vertical external wall to an inside surface thereof; and (2) a heat insulating shutter device having:

a coiled shutter housing constructed to be provided on an upper edge portion of the outside surface of said vertical external wall adjacent said opening, the housing having a lower end formed with a shutter outlet, a shutter winding-unwinding horizontal drive roller disposed within the housing, and a shutter attached to the drive roller;

said shutter including a multiplicity of slats connected to one another so as to be wound up to a coiled form;

a hollow side frame provided on each of opposite side edge portions of the wall defining the opening;

grooved shutter guides opposed to each other and each provided on inner walls of the side frames;

the shutter guides having movably fitted therein respective opposite side edge portions of the shutter;

the slats of the shutter and the side frames each having a hollow portion filled with a heat insulating material; and wherein the shutter housing includes (a) a cover having an upper sidewall portion, a front sidewall portion and a lower sidewall portion, (b) said shutter outlet being in said lower sidewall portion, (c) the upper sidewall portion being forwardly downwardly inclined over a substantial portion thereof and being fixed at its upper edge to said outside surface of said external vertical wall of the building, and (d) the lower sidewall portion providing a concave surface, therefore being rearwardly inclined downward over a substantial portion thereof in front of the shutter outlet.

* * * * *